US008909091B2

(12) United States Patent
Suzuki et al.

(10) Patent No.: US 8,909,091 B2
(45) Date of Patent: Dec. 9, 2014

(54) CHARGING DEVICE

(71) Applicant: Canon Kabushiki Kaisha, Tokyo (JP)

(72) Inventors: Kenji Suzuki, Abiko (JP); Yoshiro Nishino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/863,267

(22) Filed: Apr. 15, 2013

(65) Prior Publication Data

US 2013/0279940 A1 Oct. 24, 2013

(30) Foreign Application Priority Data

Apr. 18, 2012 (WO) ..... PCT/JP2012/060430

(51) Int. Cl.
*G03G 15/02* (2006.01)

(52) U.S. Cl.
CPC ..... *G03G 15/0291* (2013.01); *G03G 2215/027* (2013.01)
USPC ..... 399/100; 399/171

(58) Field of Classification Search
CPC ..... G03G 2215/026; G03G 2215/027; G03G 15/0291
USPC ..... 399/100, 172
See application file for complete search history.

(56) References Cited

U.S. PATENT DOCUMENTS

| | | | | |
|---|---|---|---|---|
| 3,875,407 | A * | 4/1975 | Hayne | 399/100 |
| 2009/0003870 | A1* | 1/2009 | Kidaka | 399/82 |
| 2011/0222901 | A1* | 9/2011 | Makino | 399/98 |
| 2013/0294789 | A1* | 11/2013 | Natsume et al. | 399/50 |

FOREIGN PATENT DOCUMENTS

| | | | |
|---|---|---|---|
| JP | 2003-084526 | A | 3/2003 |
| JP | 2009-128617 | A | 6/2009 |
| JP | 2010-002436 | A | 1/2010 |
| JP | 2010-145840 | A | 7/2010 |
| JP | 2010-175725 | A | 8/2010 |
| JP | 2011-186227 | A | 9/2011 |
| WO | 2011/111160 | A1 | 9/2011 |

* cited by examiner

*Primary Examiner* — Walter L Lindsay, Jr.
*Assistant Examiner* — Philip Marcus T Fadul
(74) *Attorney, Agent, or Firm* — Canon USA Inc IP Division

(57) ABSTRACT

To provide a structure in which, even when the space between a grid and a photosensitive member is narrowed so as to improve charging efficiency, wear of a shutter due to rubbing against the grid during movement of the shutter is suppressed. There is provided a mechanism that withdraws the grid to the discharge electrode side when the opening is covered with the shutter.

8 Claims, 10 Drawing Sheets

CHARGING DEVICE

TECHNICAL FIELD

The present disclosure relates to a charging device that includes a grid and a sheet-shaped shutter with which an opening is covered and uncovered.

BACKGROUND ART

An electrophotographic image forming apparatus is known in which a photosensitive member is charged with a corona charger. In particular, a product using a corona charger called a scorotron which is provided with a grid so as to stabilize a charged potential of the photosensitive member is known. In such a structure, in order to efficiently and uniformly charge the photosensitive member, arrangement of the grid of the corona charger in close proximity to the photosensitive member is known.

The fact that the corona charger charges the photosensitive member along with corona discharge is known. When corona discharge occurs in air, discharge products (ozone, nitrogen oxide, etc.) are generated. When the discharge products are deposited on the photosensitive member, the discharge products absorb moisture in a high humidity environment, thereby causing an image defect called image deletion.

On the other hand, heating the photosensitive member with a heater to suppress moisture absorption of the discharge products and suppress occurrence of image deletion has been considered. However, in terms of energy saving, it is not desirable to continuously to heat the photosensitive member with the heater so as to suppress occurrence of image deletion.

PTL 1 as identified below discloses a structure in which an opening of a corona charger that faces a photosensitive member is shielded with a shutter. Specifically, a carriage that supports an end portion of the sheet-shaped shutter is moved in the longitudinal direction of the opening and, while an image is not being formed, the opening is shielded so as to suppress deposition of discharge products onto the photosensitive member.

CITATION LIST

Patent Literature

PTL 1 Japanese Patent Laid-Open No. 2010-145840

Now, in the case where the gap between a grid and the photosensitive member is narrowed so as to improve charging efficiency, the shutter is likely to rub against the photosensitive member or the grid when the opening is covered and uncovered with the shutter.

Because it is not desirable to bring the shutter into contact with the photosensitive member, bringing the shutter into contact with the grid is considered. However, when the grid and the shutter rub against each other, the shutter is worn away. In particular, when a grid (etched grid) that is a thin flat plate having fine holes formed therein by etching is used, the shutter is markedly worn away due to rubbing against the grid.

Hence, it is difficult to suppress wear of the shutter due to rubbing against the grid due to movement of the shutter while the gap between the grid and the photosensitive member is narrowed so as to improve charging efficiency.

SUMMARY OF INVENTION

A charging device according to the present disclosure includes a shield that includes an opening on a side of a member to be charged, a discharge electrode that is provided on an inner side with respect to the shield, a grid that is provided on the side of the member to be charged with respect to the discharge electrode, a sheet-shaped shutter that moves between the member to be charged and the grid in the longitudinal direction of the opening, and covers and uncovers the opening, and a mechanism that withdraws the grid to the discharge electrode side when the opening is covered with the shutter.

Further features of the present disclosure will become apparent from the following description of exemplary embodiments with reference to the attached drawings.

DESCRIPTION OF EMBODIMENTS

The general structure of an image forming apparatus will be described below, and then a charging device will be described in detail using the drawings. It is noted that the scope of the disclosure is not limited to, for example, the dimensions, materials, shapes, and relative positions of components described herein unless an especially specific description is given.

First Embodiment

First, the general structure of an image forming apparatus will be simply described, and then a charging device (corona charger) according to this embodiment will be described in detail.

1. Outline of Image Forming Apparatus

Portions (image forming portions) involved in image formation performed by a printer 100 will be simply described below.

General Structure of Entire Apparatus

Figure 1A:
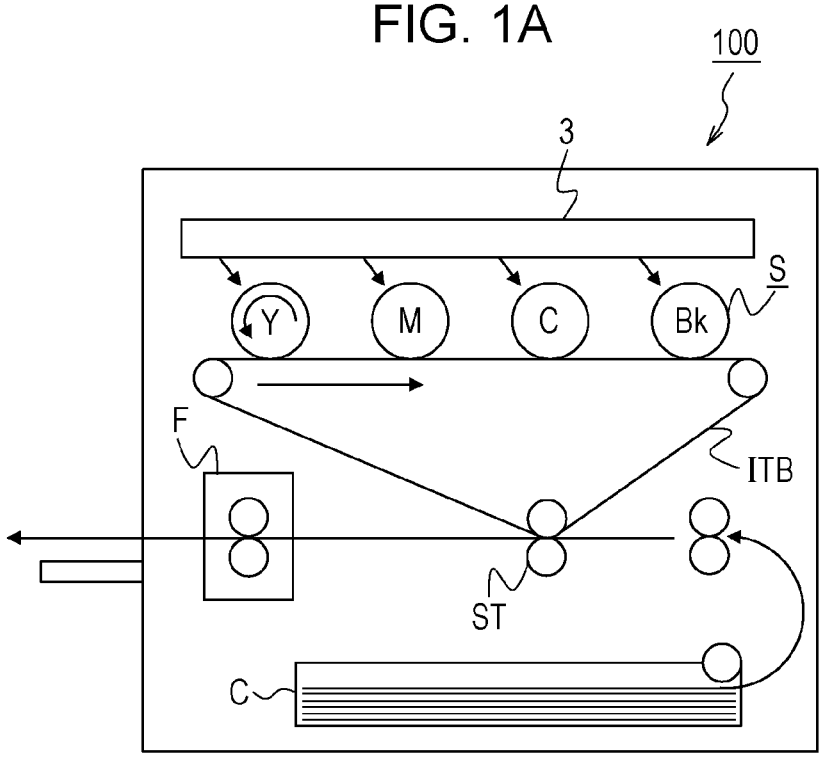
FIGS. 1A and 1B are schematic cross-sectional views of an image forming apparatus.
Figure 1B:
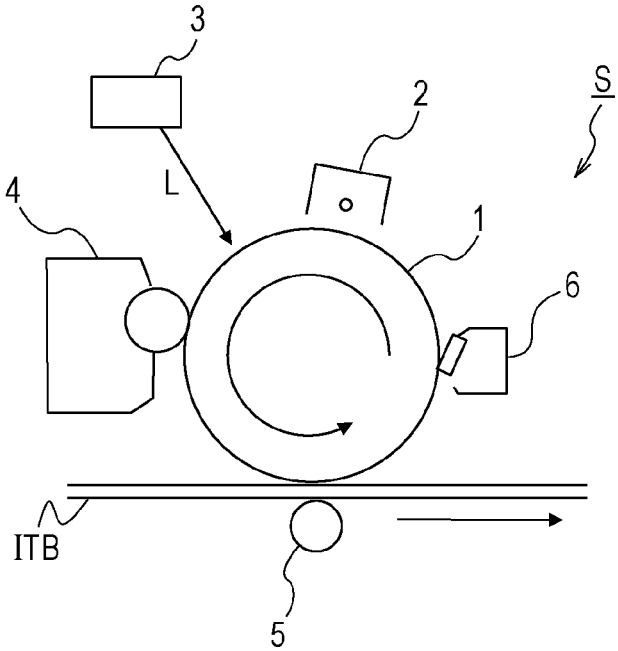

FIG. 1A illustrates the general structure of the printer 100 serving as the image forming apparatus. The printer 100 serving as the image forming apparatus includes first to fourth stations S (Bk to Y) and forms images on respective photosensitive drums of the stations with different toners. FIG. 1B is an enlarged detail view of any of the stations serving as image forming portions. The stations are substantially the same except for the type (spectral characteristics) of toner with which an electrostatic image formed on the photosensitive drum is developed. Accordingly, the first station (Bk) will be described as a representative example of the stations.

The station S (Bk) serving as the image forming portion includes a photosensitive drum 1 serving as an image carrier and a corona charger 2 serving as a charging device that charges the photosensitive drum 1. The photosensitive drum 1 is charged by the corona charger 2 and then an electrostatic image is formed on the photosensitive drum by the photosensitive drum being exposed to light L from a laser scanner 3. The electrostatic image formed on the photosensitive drum 1 (on the image carrier) is developed into a toner image with black toner contained in a development device 4. The toner image developed on the photosensitive drum 1 is transferred to an intermediate transfer belt ITB serving as an intermediate transfer member by a transfer roller 5 serving as a transfer member. Remaining toner deposited on the photosensitive drum 1 without being transferred to the intermediate transfer belt is removed and cleaned by a cleaning device 6 equipped with a cleaning blade. The corona charger, a development unit, and so forth which are involved in formation of a toner image on the photosensitive drum 1 (on a photosensitive member) are called image forming portions. The corona charger 2 (charging device) will be described in detail below.

Thus, toner images transferred from the photosensitive drums 1 included in the respective stations, in the order of yellow (Y), magenta (M), cyan (C), and black (Bk), are superimposed on the intermediate transfer belt. Subsequently, in a secondary transfer portion ST, the superimposed toner images are transferred to a recording material conveyed from a cassette C. In the secondary transfer portion ST, toner remaining on the intermediate transfer belt without being transferred to the recording material is cleaned by a belt cleaner, which is not illustrated.

The toner images transferred onto the recording material are fixed to the recording material by a fixing device F that comes into contact with the toner and fuses the toner so as to fix the toner to the recording material. Then, the recording material to which the image has been fixed is ejected to outside the apparatus. The above description is about the general structure of the entire apparatus.

2. General Structure of Corona Charger

The general structure of the corona charger will be described, and then opening and closing operations of a shutter will be simply described.

General Structure of Corona Charger

Figure 2:
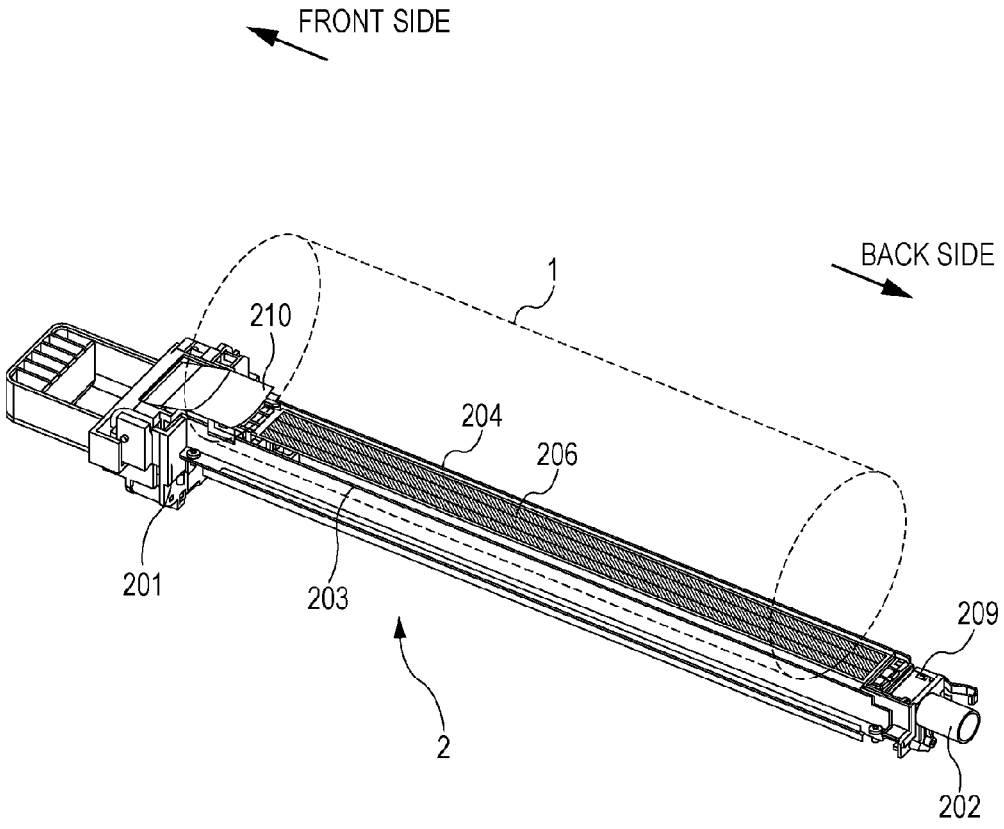
FIG. 2 is a perspective view illustrating the external appearance of a corona charger according to an embodiment.
Figure 3:
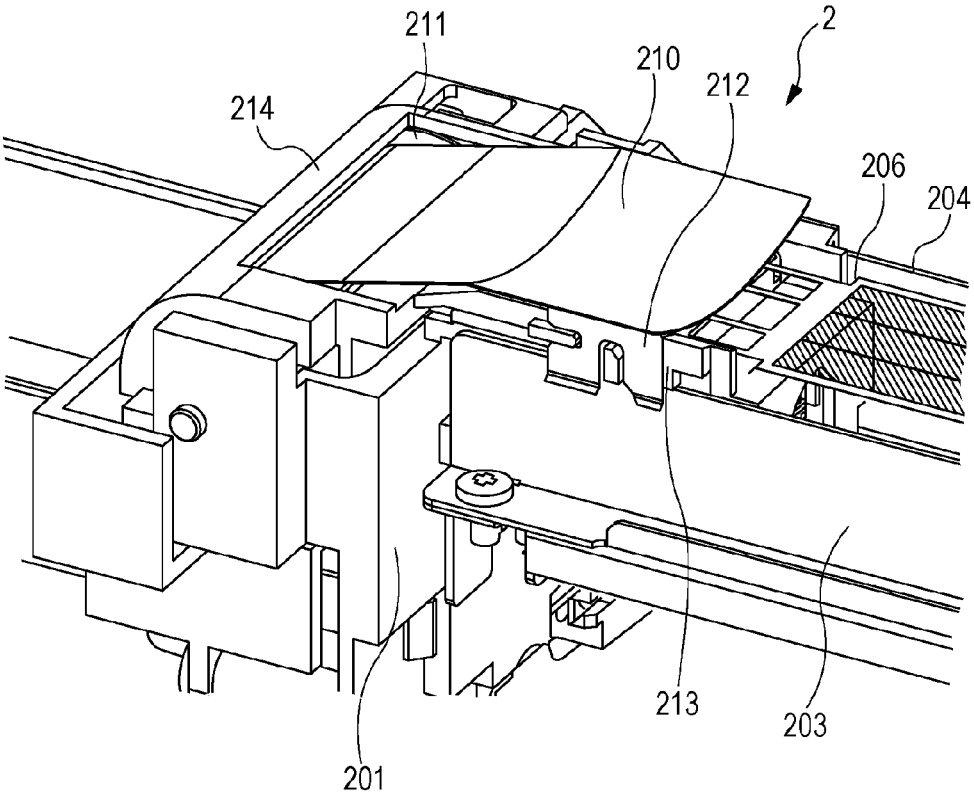
FIG. 3 is an enlarged view of the vicinity of a housing portion for a shutter of the corona charger according to the embodiment.

FIG. 2 is a schematic perspective view of the corona charger 2 viewed from the photosensitive member side and FIG. 3 is an enlarged view of the vicinity of a housing portion for a shutter of the corona charger according to this embodiment. The corona charger 2 includes a grid 206 and a sheet-shaped shutter 210 capable of shielding an opening (opening portion) of the corona charger on the photosensitive member side (side of a member to be charged).

The corona charger 2 includes a front block 201, a back block 202, and shields 203 and 204. A discharge wire 205 serving as a discharge electrode extends between the front block 201 and the back block 202 under tension, and when a charging bias is applied to the discharge wire 205 by a high-voltage source, the discharge wire 205 discharges to charge the photosensitive member 1 serving as the member to be charged. The discharge electrode extending on an inner side with respect to the shields under tension may be shaped like a wire having a circular cross section or a thin flat plate having a sawtooth shape.

Grid Electrode

The corona charger 2 includes the flat-plate-shaped grid 206 serving as a control electrode provided in an opening, on the side facing the photosensitive member, of openings formed by the shields 203 and 204. The grid 206 is disposed between the discharge wire 205 and the photosensitive member 1 and controls the amount of current which flows to the photosensitive member due to application of a charging bias.

Here, in this embodiment, as the grid 206 serving as the control electrode, a so-called etched grid that is a thin metallic plate (thin sheet) subjected to an etching process (etching) is used. As illustrated in FIG. 3, the etched grid has beam portions in the opposite end portions in the longitudinal direction of the grid and has small windows (opening portions) obliquely arranged between the beam portions.

The flat-plate-shaped grid 206 is supported under tension (extending under tension) by tension portions 207 and 209 disposed in the front block 201 and the back block 202, respectively. Support for the grid 206 is removed by operating a knob 208 of the tension portion 207 disposed in the front block 201, and the grid 206 is readily attachable and detachable (see FIGS. 5A to 5C). In addition, the grid 206 has a bent shape in a portion of the flat plate in the vicinity of the tension portion 209 and has elasticity to some extent. Hence, even in a state in which the grid extends under tension in the corona charger, the grid is capable of moving to some extent when subjected to an external force.

Shutter and Housing Portion for Shutter

Next, the shutter and a structure of winding up and housing the shutter will be described using FIG. 3.

The corona charger 2 includes the sheet-shaped shutter 210 that shields the entire area (about 300 mm in width) of at least a portion, over which an image is formed on the photosensitive member, of the opening (about 360 mm in width) which is formed by the shields and faces the photosensitive member. The shutter 210 moves through the gap between the grid 206 and the photosensitive member 1 so as to cover and uncover the opening portion formed by the shields. In the image forming apparatus according to this embodiment, when the shutter is in an open state, the distance between the grid 206 and the photosensitive member 1 at a position at which they are closest to each other is about 1.0 mm and this is narrow. Hence, as the shutter 210, a soft, flexible, sheet-shaped non-woven fabric (rayon fiber) is used so that the photosensitive member is not damaged even when the photosensitive member comes into contact with the shutter.

The shutter 210 is wound up in a roll shape and housed by a winding-up mechanism 211 that winds up the shutter in an end portion of the corona charger 2 in the longitudinal direction of the corona charger 2. The winding-up mechanism 211 includes a roller to which an end portion of the shutter is fastened and a torsion coil spring that urges the roller. The shutter 210 is urged by the coil spring in the direction in which the shutter is wound up (in the direction in which the opening is uncovered), so that the shutter is less likely to sag in the center in the longitudinal direction of the shutter. The winding-up mechanism 211 and a holding case 214 that holds the winding-up mechanism 211 are held by the front block 201. A guide roller 215 that guides (leads) the shutter 210 so that the shutter 210 does not come into contact with an edge of the grid 206, the tension portion 207, the knob 208, and so forth is disposed in the vicinity of a shutter drawing portion of the holding case 214.

The other end portion of the shutter 210 in the longitudinal direction of the shutter 210 is fastened to a leaf spring 212. The leaf spring 212 holds and pulls the shutter in the closing direction, and also regulates the sheet-shaped shutter to form an arch-shape, thereby providing resilience to the sheet. Specifically, the center portion of the shutter in the short side direction of the shutter is regulated by the leaf spring 212 so as to have a shape that projects toward the discharge wire side.

In addition, the leaf spring 212, serving as a pulling member and a regulating member, which holds the vicinity of the leading end of the shutter 210 is connected to a carriage 213 serving as a movable member. In this embodiment, as for the shutter 210 and the leaf spring 212, metallic materials having thicknesses of 0.15 mm and 0.10 mm, respectively, are used. Although thin, the leaf spring 212 has sufficient strength to pull the shutter. Here, the leaf spring 212 serving as the regulating member has a lower wear resistance than the shutter. Accordingly, in the leading end portion, the leaf spring is provided so as to be located on the grid side (see FIGS. 3, 6, 7, and 8).

When the carriage 213 is driven by a screw 217 provided above the corona charger and moves to the back side (in the direction in which the opening is covered), the shutter 210 is drawn from the winding-up mechanism 211. When the carriage 213 moves to the front side (in the direction in which the opening is uncovered), the shutter 210 is wound up by the winding-up mechanism 211 and is housed in the holding case 214.

Opening and Closing Control of Shutter

Figure 4A:
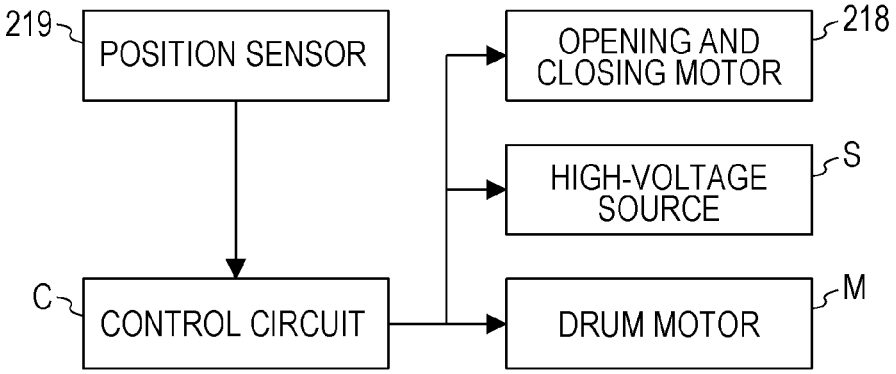
FIGS. 4A and 4B each illustrate opening and closing control of the shutter of the corona charger according to the embodiment.
Figure 4B:
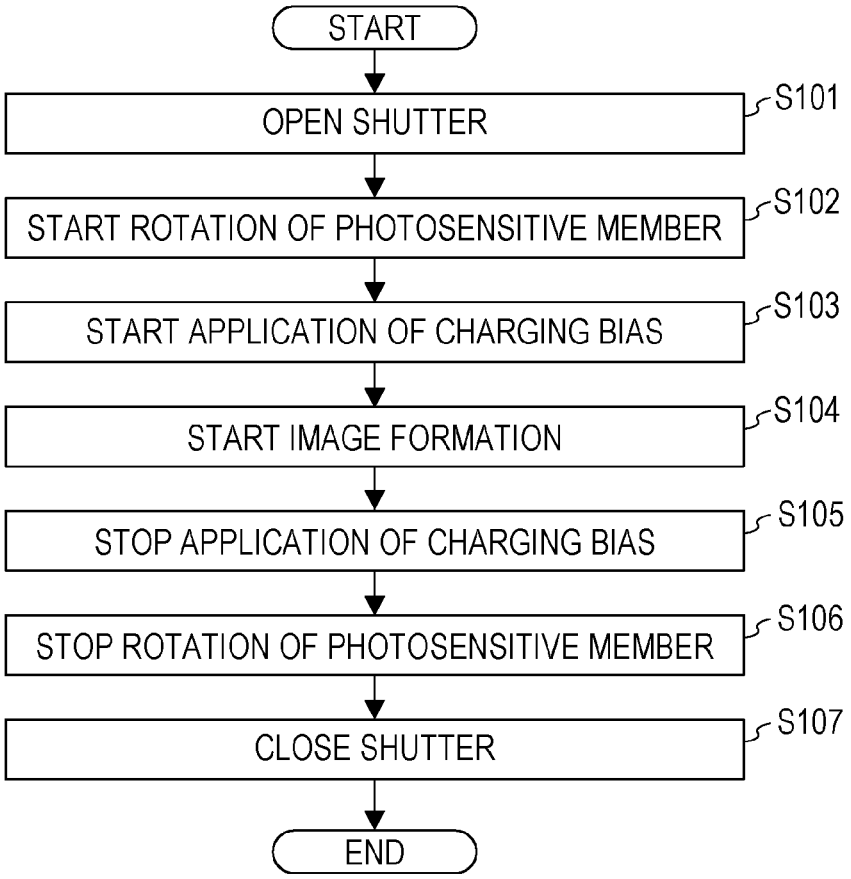

Next, opening and closing control of the shutter of the corona charger 2 will be simply described. FIG. 4A is a block diagram schematically illustrating a control circuit and FIG. 4B is a flowchart illustrating the contents of the control.

As illustrated in FIG. 4A, a control circuit (controller) C serving as a control unit controls, in accordance with a program retained therein, an opening and closing motor serving as a driving source, a high-voltage source, and a drum motor. A position sensor notifies the control circuit of the absence or presence of a flag.

Operations performed by the corona charger while an image is being formed will be described below using the flowchart.

The control circuit C receives an image forming signal, drives the opening and closing motor on the basis of an output of the position sensor 219 when the shutter is in a closed state, and moves the shutter so as to uncover the opening (S101). Subsequently, when the shutter is in a retracted state (the opening is uncovered), the control circuit C drives the drum motor M so as to rotate the photosensitive member 1 (S102).

In order to charge the photosensitive member, the control circuit C performs control so that a charging bias is applied to the discharge wire and the grid from the high-voltage source (S103).

Individual elements involved in image formation are caused to act on the photosensitive member 1 charged by the corona charger 2, so that an image is formed on a sheet (S104). After image formation is completed, the control circuit C stops application of the charging bias to the corona charger (S105), and then stops rotation of the photosensitive member (S106).

After rotation of the photosensitive member is stopped, the control circuit C rotates the opening and closing motor 218 in reverse and causes the opening and closing motor 218 to perform an operation of covering the opening with the shutter (S107). The closing operation of the shutter 210 may be performed immediately after an image is formed or after a certain time period has elapsed since image formation was completed.

3. Mechanism that Withdraws Grid

The position of the grid involved in opening and closing operations of the shutter will be simply described, and then a withdrawal mechanism that pulls back the grid to the wire side will be described in detail.

Opening and Closing Operations of Shutter and Grid Position

The carriage 213 serving as the movable member is driven by the screw 217 and the opening and closing motor 218 and moves in the longitudinal direction of the corona charger. The structure is employed in which a cleaning pad 216 that cleans the discharge wire 205 is held by the carriage 213 and cleans the discharge wire 205 simultaneously with opening and closing operations of the shutter 210.

Here, the corona charger 2 includes the position sensor 219 and a detection flag 220 that screens a detection portion of the position sensor 219 when the shutter is in an open position. The position sensor 219 detects that the shutter 210 is in an open position (home position) when the detection portion is screened by the detection flag 220.

Figure 5A:
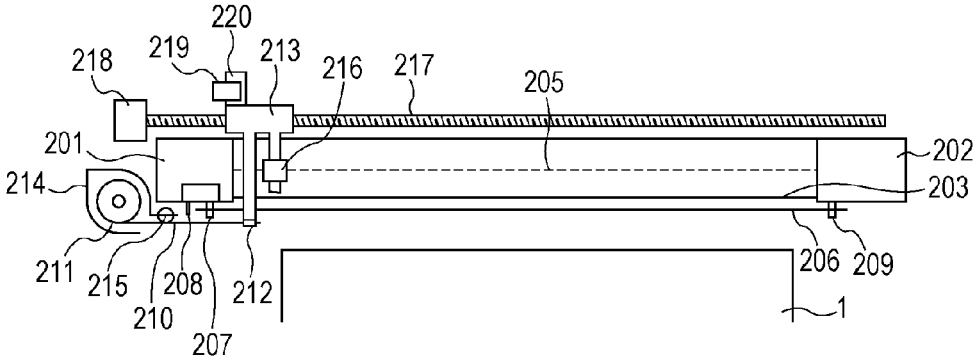
FIGS. 5A to 5C are side views of the corona charger according to the embodiment when opening and closing operations of the shutter are performed.

FIG. 5A is a side view of the corona charger 2 in a state in which the carriage 213 is in the home position. In the state in FIG. 5A (the shutter is in an open state), the grid 206 extends substantially parallel to the photosensitive member under tension. The space between the grid 206 and the photosensitive member 1 is about 1.0 to 1.5 mm in substantially the center, in a portion in which they are close to each other. In this embodiment, the fact that the grid is substantially parallel to the photosensitive member means that the angle formed by the line of the beams of the grid 206 and the generating line of the drum-shaped photosensitive member 1 is within one degree.

Now, the leading end portion (one end in the closing direction) of the shutter 210 is thick by the thickness of the leaf spring 212 that pulls the shutter. In other words, because the leaf spring is attached to the shutter, the leading end portion of the shutter has a thickness obtained by adding the thickness of the shutter and the thickness of the leaf spring. As a matter of course, it is possible to increase assembly accuracy and to cause the leaf spring to pass through the gap (about 1 mm) between the photosensitive member and the grid; however, this results in cost increases and this is not desirable. Even with consideration of an error in assembly of the corona charger, the leaf spring prevents contact with the photosensitive member, but instead is rubbed against the grid, so that the shutter is likely to rub against the grid and this is not desirable. In particular, in the case where an etched grid that is a thin plate-shaped grid having a plurality of opening portions therein is used, when opening and closing operations of the shutter are performed in a state in which the gap between the photosensitive member and the grid is narrow, the thick portion of the leaf spring 212 may be caught on the grid.

Figure 5B:
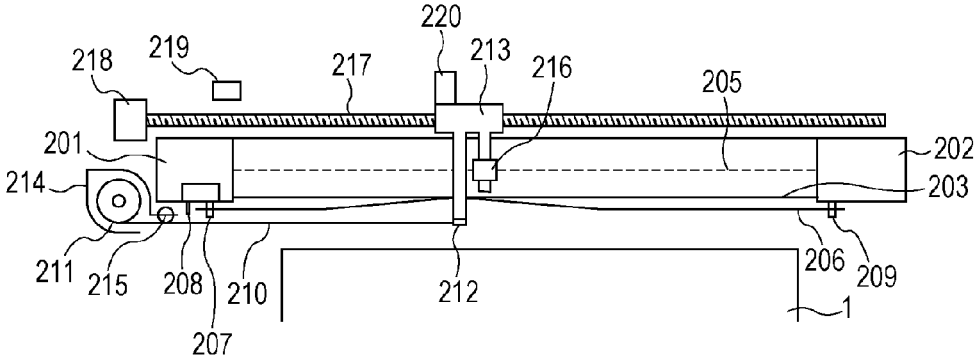

Thus, in the corona charger according to this embodiment, the carriage 213 is provided with a mechanism that withdraws the grid 206 by pulling back the grid 206 to the wire side (discharge electrode side) so that the leaf spring 212 that is provided at the leading end portion of the shutter and performs a pull operation is less likely to come into contact with the grid. Accordingly, as illustrated in FIG. 5B, when the opening is covered with the shutter, the grid is withdrawn, so that rubbing between the leaf spring or the shutter and the grid may be suppressed. Because a leading end position 212A of the leaf spring 212 moves between the grid tension portions 207 and 209, the grid may smoothly become deformed toward the discharge wire side.

Figure 5C:
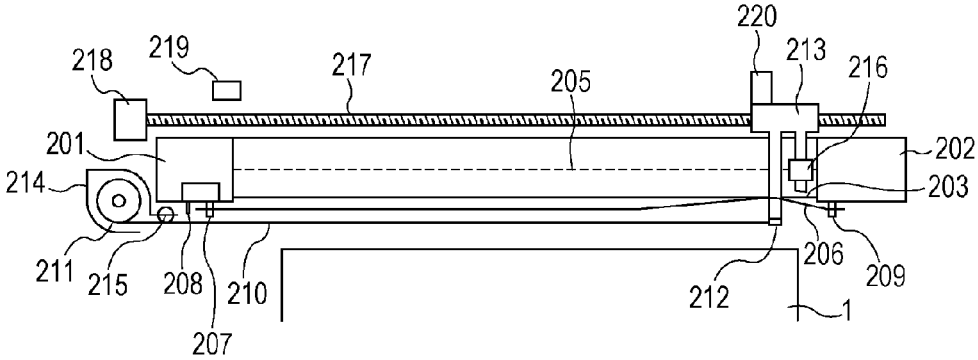

FIG. 5C is a side view of the corona charger 2 which illustrates the position of the shutter while an image is not being formed (that is, the position at which the opening is covered). Here, because the cleaning pad 216 that cleans the discharge wire is provided in the carriage 213, the shutter does not shield the entire area of the opening formed by the shields on the photosensitive member side (that is, some gaps are generated) even when the shutter is in the position illustrated in FIG. 5C. As a matter of course, as long as the shutter 210 is in the state in FIG. 5C, the shutter 210 shields at least the entire area of an image formation area in which an electrostatic image is formed by exposing the photosensitive member to light. Hence, as long as a portion in which an image is substantially formed is covered with the shutter, occurrence of image deletion may be fully suppressed, so that it may be said that the opening is substantially covered with the shutter.

As illustrated in FIGS. 5B and 5C, a position at which the grid is pulled back to the discharge wire side is a position at which the grid overlaps the leaf spring 212. This may prevent the leaf spring from being caught on the grid or prevent the shutter from being worn away with the amount of movement of the grid being small.

When the shutter becomes closed, the entire longitudinal area of the grid may be withdrawn to the wire side. In this case, in order to absorb the displacement due to withdrawal of the grid so that the grid tension portions are not overloaded, a structure is preferably employed in which the grid tension portions are movable and also urged by a spring. As a matter of course, it is desirable that a portion of the grid which is withdrawn is kept to the minimum necessary so as to ensure the position accuracy of the grid. Accordingly, in this embodiment, a structure is employed in which the grid is withdrawn in part (5.0 mm in width) to the wire side in the vicinity of the end portion (leaf spring) on the shutter-closing direction side. In this embodiment, the amount by which the grid is pulled back is 1.0 mm and the position of the leaf spring is the vicinity of a position at which a pull-back operation is performed (within 12.0 mm from a pull-back position). A projecting portion of an arch-shaped portion of the shutter which is regulated by the leaf spring has a gentler arch-shape with distance from the leaf spring. Hence, the portion of the shutter in the vicinity of the leaf spring is more likely to be worn away due to rubbing against the grid than the portion far away from the leaf spring.

Enlarged View of Grid Withdrawal Mechanism

Figure 6:
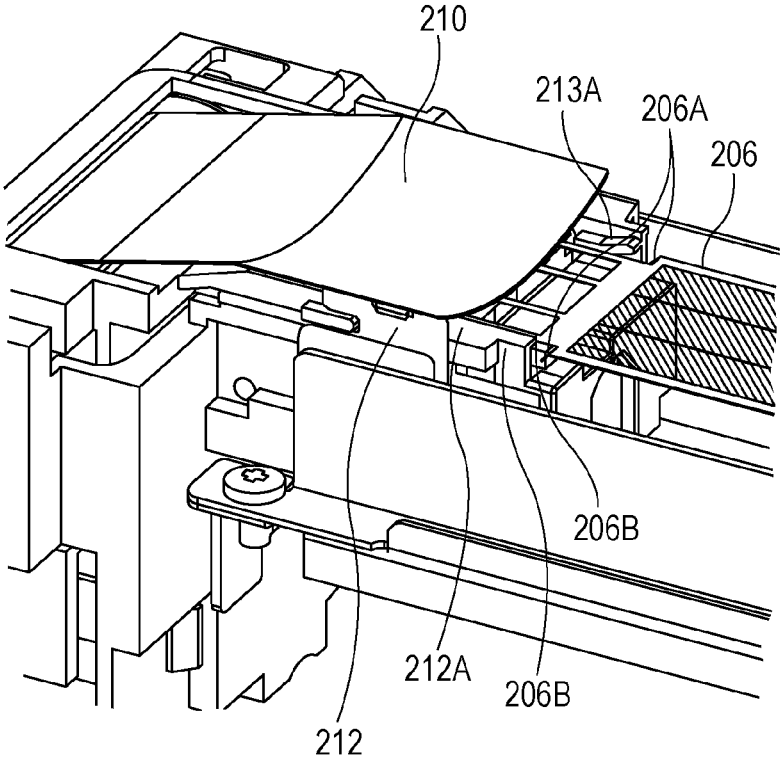
FIG. 6 illustrates a grid pull-back mechanism of the corona charger according to the embodiment.

Next, a mechanism that withdraws the grid according to this embodiment to the discharge wire side by pulling back the grid to the discharge wire side and the feature thereof will be described in detail. FIG. 6 is an enlarged view illustrating a withdrawal mechanism that withdraws the grid of the corona charger 2.

As illustrated in FIG. 6, in order to withdraw the grid to the discharge wire side, the carriage 213 is provided with a tapered portion 213A that moves the grid to the wire side. Even during opening and closing operations of the shutter, the tapered portion 213A maintains a relative distance of 2.0 mm from the leading end position 212A of the shutter in the longitudinal direction of the grid. The grid 206 has a partially cutaway shape so that the grid 206 does not come into contact with the tapered portion of the carriage located at the position at which the shutter is open.

When the shutter is in an open position, the tapered 213A serving as a grid pull-back portion is located at a cutaway portion 206B of the grid 206. Accordingly, the grid extends under tension by the tension portions in a charging position substantially parallel to the photosensitive member without the tapered 213A coming into contact with the grid 206 during a charging operation. In order to facilitate engagement with the tapered portion provided in the carriage, the grid 206 has a slope 206A that is bent toward the discharge wire side.

Figure 7:
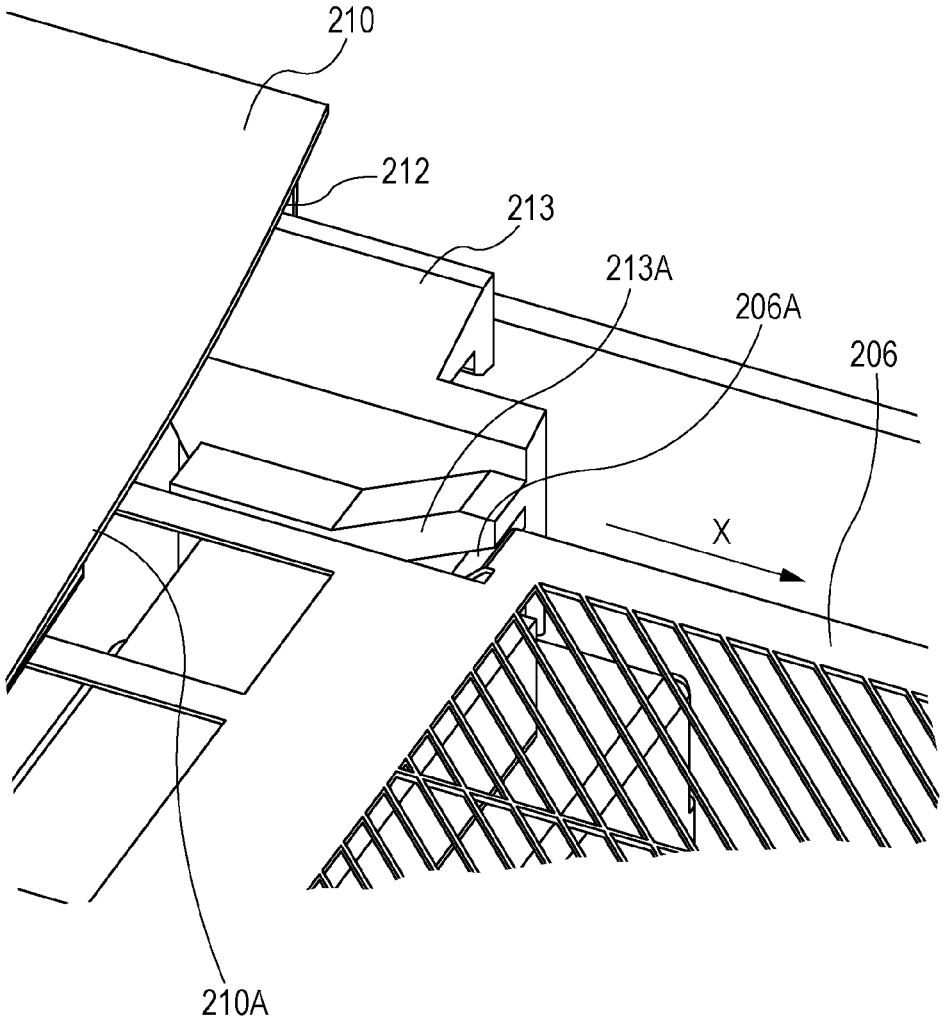
FIG. 7 is an enlarged view illustrating a state immediately before withdrawal of a grid according to the embodiment.
Figure 8:
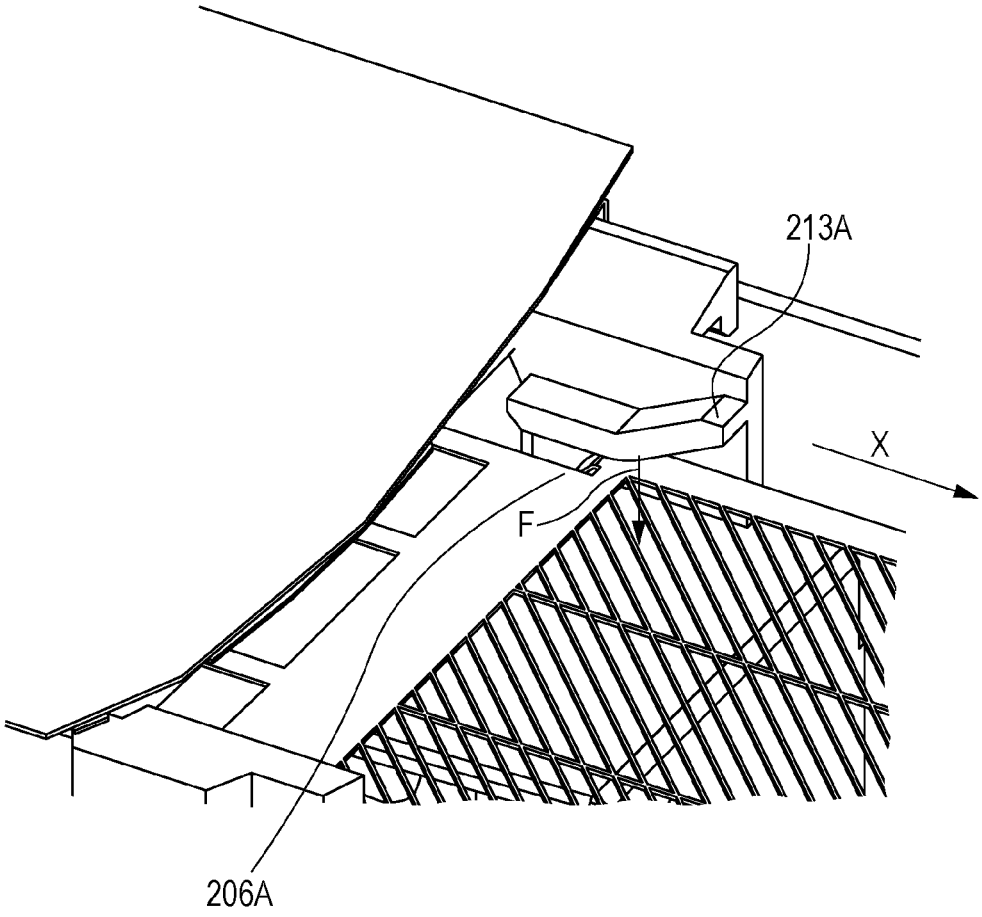
FIG. 8 is an enlarged view illustrating a state during a withdrawal operation of the grid according to the embodiment.

Next, an operation performed when part of the grid 206 becomes deformed and is pulled back to the discharge wire side will be described using more detailed enlarged views (FIGS. 7 and 8)

FIG. 7 is an enlarged view of the contact portion between the carriage 213 and the grid 206 when the opening is covered with the shutter 210 from a state in which the opening is uncovered. A leading end portion 210A of the shutter 210 is urged into an arch-shape by the leaf spring and is located at the position at which the openings of the grid are uncovered. When the carriage 213 moves in an arrow X direction in the figure, the tapered portion 213A of the carriage 213 for pulling back the grid to the charging wire side comes into contact with the tapered portion 206A of the grid. When the carriage moves more in the arrow X direction with respect to the position illustrated in FIG. 7, the grid is subjected to a force from the tapered portion 213A of the carriage and part of the grid becomes deformed toward the discharge wire side.

FIG. 8 is an enlarged view of the contact portion between the carriage and the grid in a state in which the carriage has withdrawn the grid to the discharge wire side. The tapered portion 213A serving as a grid pull-back mechanism and the tapered portion 206A of the grid 206 are provided in opposite ends in the grid width direction. The grid 206 continues to be subjected to a force F in a direction from the tapered portion of the carriage toward the discharge wire side while being deformed and withdrawn from the photosensitive member toward the discharge wire side. As illustrated in FIG. 8, the leading end position 212A of the leaf spring 212 is placed upstream from the tapered portion 213A in the shutter-closing direction. Hence, the leaf spring may readily pass through a larger gap obtained by withdrawal to the discharge wire side performed by the tapered portion 213A.

Figure 9A:
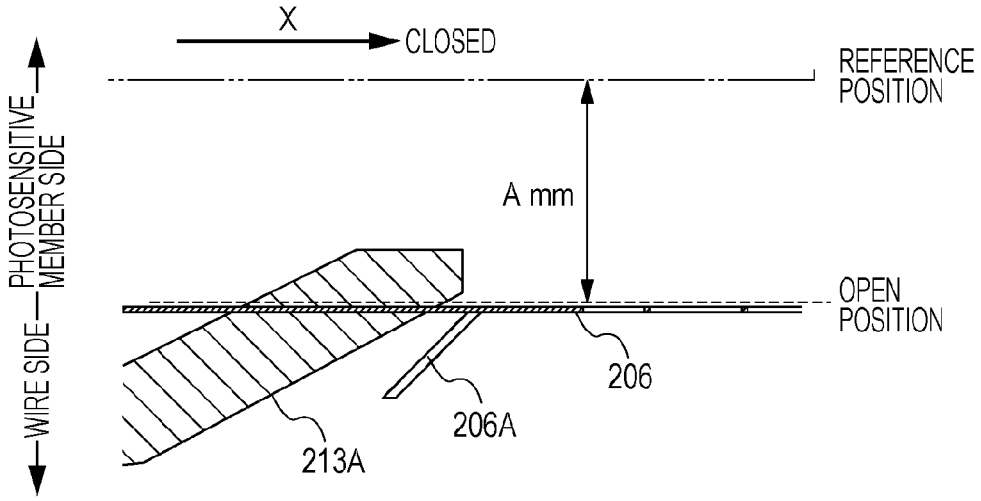
FIGS. 9A and 9B are cross-sectional views illustrating the withdrawal operation of the grid according to the embodiment.
Figure 9B:
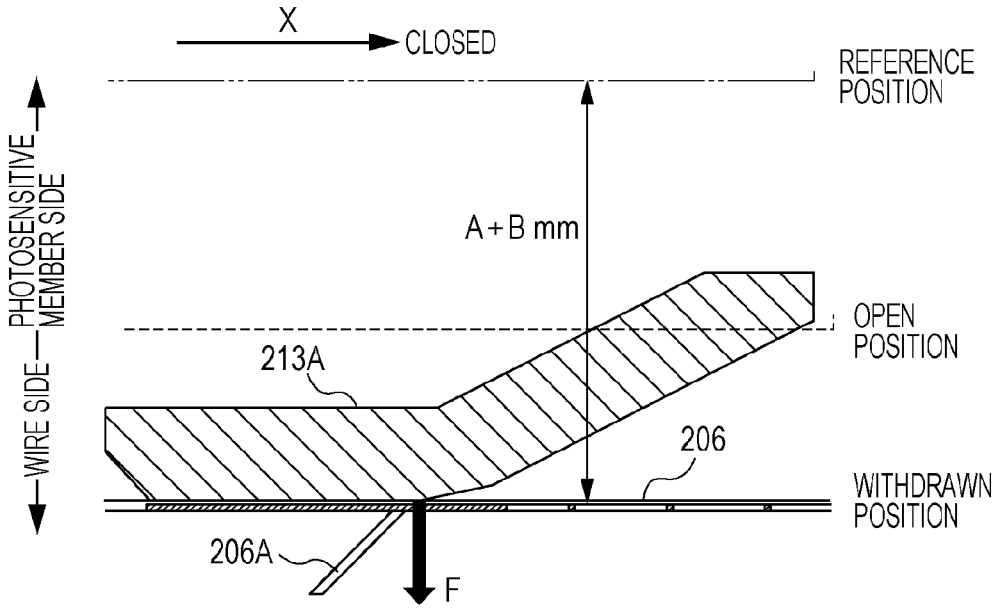

Lastly, withdrawal of the grid performed by the withdrawal mechanism will be simply described using cross-sectional views. FIG. 9A is a cross-sectional view illustrating a state (state in FIG. 7) in which the tapered portion 213A of the carriage is not in contact with the tapered portion 206A of the grid. In this state, the distance between the photosensitive member 1 and the grid 206 is about 1 mm (A mm in the figure). Next, FIG. 9B is a cross-sectional view illustrating a state (state in FIG. 8) in which the tapered portion 213A of the carriage goes beyond the tapered portion 206A of the grid and withdraws the grid 206 to the discharge wire side. At this time, at the contact surface between the carriage and the grid, the grid 206 is subjected to the force F in the direction toward the discharge wire and becomes deformed. In the state in FIG. 9B, the distance between the photosensitive member 1 and a portion withdrawn due to deformation of the grid 206 is about 2 mm (A+B mm in the figure). That is, the distance (A mm) between the grid and the photosensitive member when the shutter 210 is open is shorter than the distance (A+B mm) between the grid and the photosensitive member when the shutter is closed. Thus, even when the space between the grid and the photosensitive member is narrowed so as to improve charging efficiency, wear of the shutter due to rubbing against the grid during movement of the shutter may be suppressed.

In this embodiment, the grid pull-back member 213A is an integral component that is integrated with the carriage 213, or alternatively, may be a separate component. Furthermore, as the withdrawal mechanism that withdraws the grid 206 toward the discharge wire side, a magnet, a piezoelectric element, or the like may be used. As in this embodiment, if the structure is employed in which the driving force of the opening and closing motor 218 that opens, closes, and moves the shutter is used, the structure may be simplified and this is desirable.

Second Embodiment

This embodiment will be described below. The structures the same as those in the first embodiment are denoted by the same reference numerals, and repeated description thereof is appropriately omitted. A charging device according to this embodiment includes a cleaning brush that cleans the grid. A mechanism that withdraws the grid 206 from the leaf spring 212 that pulls the shutter is the same as that in the embodiment, and description thereof is omitted.

Figure 10A:
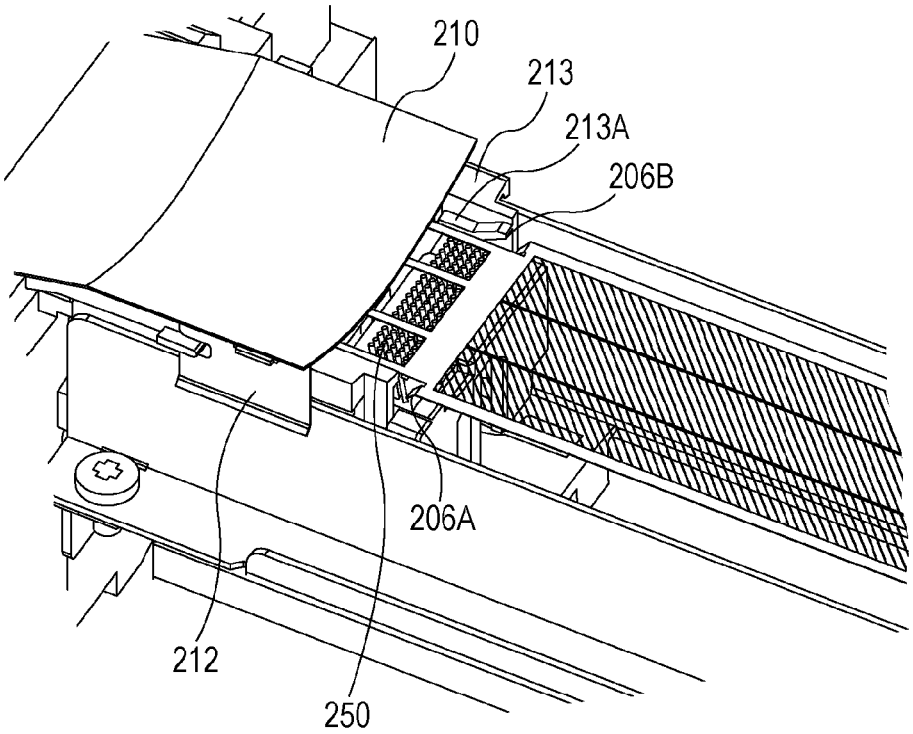
FIGS. 10A and 10B are perspective views of a corona charger including a cleaning brush according to an embodiment.

FIG. 10A is a perspective view of the corona charger 2 serving as the charging device according to this embodiment. In the corona charger 2 according to this embodiment, a cleaning brush 250 that cleans the grid is provided in the carriage 213 that is driven by a screw so as to move an end portion of the shutter in the longitudinal direction of the opening. The cleaning brush 250 serving as a grid cleaning member removes toner that has entered from the surface of the grid on the discharge wire side toward the photosensitive member and adhered to the grid, dust, lint that has come from a non-woven fabric, and the like.

While an image is being formed, the cleaning brush 250 is withdrawn from the grid 206 so that the grid 206 maintains a desired distance (about 1 mm across the entire area) from the photosensitive member. Specifically, when the shutter is in an open position, the cleaning brush 250 is withdrawn to the vicinity of the position of the cutaway portion 206B of the grid so as to reduce stress on the grid.

Figure 10B:
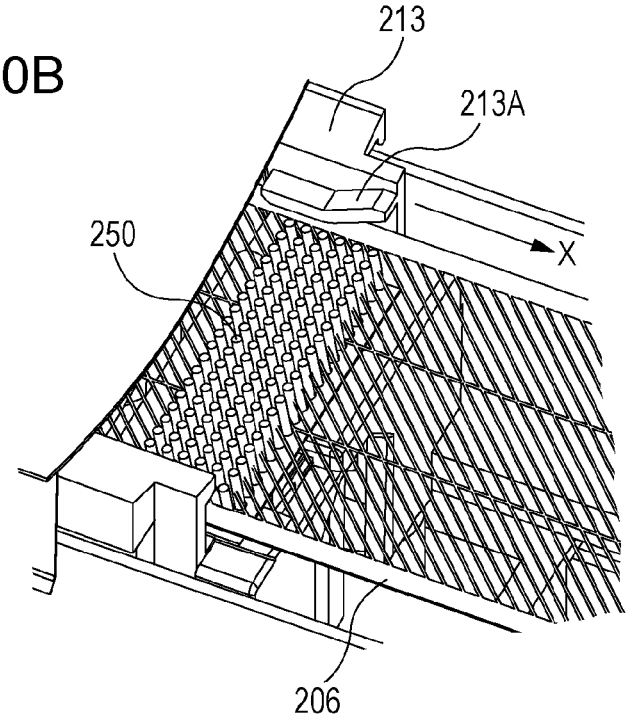

Next, an operation performed when the grid is cleaned with the cleaning brush 250 will be described using FIG. 10B. When the grid is cleaned, the cleaning brush 250 is caused to enter the grid by a certain amount and simultaneously moved in an arrow X direction so as to clean the grid.

Now, there is a possibility that the grid 206 will be deformed toward the photosensitive member 1 side when the cleaning brush 250 is caused to enter the grid 206. Accordingly, in this embodiment, the cleaning brush 250 is held by the carriage 213 provided with the tapered portion 213A that withdraws the grid to the discharge wire side. That is, the cleaning brush cleans substantially the same place as a place in the grid which is locally withdrawn by the mechanism. Thus, the grid 206 is cleaned with the cleaning brush 250 and simultaneously deformation of the grid 206 toward the photosensitive member 1 may be suppressed. In other words, the grid 206 is cleaned and simultaneously the leaf spring 212 that holds the leading end portion 210A of the shutter may be caused to readily pass between the photosensitive member 1 and the grid 206.

Such a structure serving as the entry structure to the grid 206 when the grid cleaning brush 250 is operated and as the withdrawal mechanism from the grid 206 when the shutter is opened and closed may improve charging stability by performing periodic cleaning of the grid.

Even when the space between a grid and a photosensitive member is narrowed so as to improve charging efficiency, wear of a shutter due to rubbing against the grid during movement of the shutter may be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of International Patent Application No. PCT/JP2012/060430, filed Apr. 18, 2012, which is hereby incorporated by reference herein in its entirety.

The invention claimed is:

1. A charging device comprising:

a shield that includes an opening on a side of a member to be charged;

a discharge electrode that is provided on an inner side with respect to the shield;

a grid that is provided on the side of the member to be charged with respect to the discharge electrode;

a sheet-shaped shutter that moves between the member to be charged and the grid in a longitudinal direction of the opening, and covers and uncovers the opening; and a mechanism that withdraws the grid to the discharge electrode side when the opening is covered with the shutter.

2. The charging device according to claim 1, further comprising:

a movable member that holds one end of the shutter and moves in a longitudinal direction of the grid, wherein the mechanism withdraws, on a shutter-closing direction side with respect to the movable member and proximate the movable member, part of the grid to the discharge electrode side.

3. The charging device according to claim 2, further comprising:

a grid cleaning member that cleans a surface of the grid on the discharge electrode side, wherein the grid cleaning member cleans the part of the grid which is withdrawn to the discharge electrode side by the mechanism.

4. The charging device according to claim 2, wherein the mechanism receives a driving force from a driving source for moving the movable member in the longitudinal direction of the grid and withdraws the grid to the discharge electrode side.

5. The charging device according to claim 4, wherein the mechanism includes a pull-back member located on the shutter-closing direction side with respect to the movable member, that receives the driving force from the driving source, and that moves in the longitudinal direction, and the pull-back member includes a tapered portion that comes into contact with the grid and that provides a force with which the grid is withdrawn to the discharge electrode side.

6. The charging device according to claim 1, wherein the grid is flat-plate-shaped and the shutter is regulated so as to have a shape that projects toward the discharge electrode side in a center portion of the shutter in a short side direction of the shutter.

7. The charging device according to claim 1, wherein the grid is a thin plate-shaped etched grid that has beam portions in opposite end portions in a longitudinal direction of the grid and that has a plurality of openings obliquely arranged between the beam portions.

8. The charging device according to claim 1, wherein the shutter includes a regulating member that regulates a center portion of the shutter in a short side direction of the shutter so that the center portion has a shape that projects toward the discharge electrode side, and the regulating member is attached to a surface of the shutter on the grid side.

* * * * *